US007767003B2

(12) United States Patent
Van Niekerk

(10) Patent No.: US 7,767,003 B2
(45) Date of Patent: Aug. 3, 2010

(54) REMOVAL OF CONTAMINANTS FROM A CONTAMINATED GAS OR VAPOUR STREAM

(75) Inventor: Erasmus Van Niekerk, La Croix Valmer (FR)

(73) Assignee: Veritruff (Proprietary) Limited, Kempton Park (ZA)

( * ) Notice: Subject to any disclaimer, the term of this patent is extended or adjusted under 35 U.S.C. 154(b) by 0 days.

(21) Appl. No.: 12/039,802

(22) Filed: Feb. 29, 2008

(65) Prior Publication Data

US 2009/0056291 A1 Mar. 5, 2009

Related U.S. Application Data

(63) Continuation of application No. 10/533,763, filed as application No. PCT/IB03/04917 on Nov. 4, 2003, now abandoned.

(30) Foreign Application Priority Data

Nov. 4, 2002 (ZA) ..... 2002-8936

(51) Int. Cl.
*B01D 46/00* (2006.01)
*B01D 47/00* (2006.01)

(52) U.S. Cl. ..... 95/214; 95/287; 126/299 D; 126/299 R; 96/371; 55/482; 55/385.1; 55/525; 55/DIG. 36

(58) Field of Classification Search ..... 126/299 R, 126/299 D; 95/212, 214, 287; 55/482, 485, 55/385.1, 525, DIG. 36; 96/371
See application file for complete search history.

(56) References Cited

U.S. PATENT DOCUMENTS 2,065,871 A * 12/1936 Rehfus ..... 55/489
2,122,582 A 7/1938 Norris
4,099,941 A * 7/1978 Gutermuth et al. ..... 55/434.1

(Continued)

FOREIGN PATENT DOCUMENTS

DE 4330912 A1 3/1995

(Continued)

OTHER PUBLICATIONS

International Search Report for International Patent Application No. PCT/IB03/04917-0 dated Jan. 23, 2004 by the Austrian Patent Office (2 pages).

*Primary Examiner*—Duane Smith
*Assistant Examiner*—Ives Wu
(74) *Attorney, Agent, or Firm*—Marshall, Gerstein & Borun LLP

(57) ABSTRACT

A method of removing contaminants from a contaminated gas or vapor stream, which method includes passing a contaminated gas or vapor stream through a bed of curled separating media linearly in an upward direction at a linear velocity of up to 6 m/s; allowing a contaminant in the contaminated gas or vapor stream to collect on the separating media as the gas or vapor stream passes through the bed of separating media, thereby removing the contaminant from the gas or vapor stream and thus purifying the gas or vapor stream; allowing the contaminant that has collected on the separating media to pass from the separating media into a collection zone; removing the contaminant from the collection zone; and withdrawing a purified gas or vapor stream from the bed of separating media.

6 Claims, 2 Drawing Sheets

U.S. PATENT DOCUMENTS

| | | | | | |
|---|---|---|---|---|---|
| 4,617,089 | A | * | 10/1986 | Ullrich et al. | 159/43.1 |
| RE33,444 | E | | 11/1990 | Lerner | |
| 5,456,244 | A | * | 10/1995 | Prasser | 126/299 D |
| 5,671,726 | A | * | 9/1997 | Hsu | 126/299 D |
| 5,904,751 | A | | 5/1999 | Van Niekerk | |
| 5,935,300 | A | * | 8/1999 | Niekerk | 95/212 |
| 6,196,214 | B1 | | 3/2001 | Van Niekerk et al. | |
| 6,443,114 | B2 | * | 9/2002 | Minegishi et al. | 123/184.61 |

FOREIGN PATENT DOCUMENTS

| | | | |
|---|---|---|---|
| EP | 0029807 | A1 | 6/1981 |
| FR | EP0774290 | A1 * | 5/1997 |

* cited by examiner

REMOVAL OF CONTAMINANTS FROM A CONTAMINATED GAS OR VAPOUR STREAM

CROSS-REFERENCE TO RELATED APPLICATION

This application is a continuation of application Ser. No. 10/531,763 filed Mar. 13, 2006, which is based on International Patent Application No. PCT/IB03/04917 filed on Nov. 4, 2003, which application claims priority of South African Patent Application No. 2002-8936 filed Nov. 4, 2002. The entire text of the priority application is incorporated herein by reference in its entirety.

FIELD OF THE INVENTION

This invention relates to the removal of contaminants from a contaminated gas or vapour stream. In particular, it relates to a method of, and apparatus for, removing contaminants from a contaminated gas or vapour stream, and to a cooking installation.

BACKGROUND AND PRIOR ART

According to a first aspect of the invention, there is provided a method of removing contaminants from a contaminated gas or vapour stream, which method includes passing a contaminated gas or vapour stream through a bed of curled separating media in an upward direction; allowing a contaminant in the contaminated gas or vapour stream to collect on the separating media as the gas or vapour stream passes through the bed of separating media, thereby removing the contaminant from the gas or vapour stream and thus purifying the gas or vapour stream; allowing the contaminant that has collected on the separating media to pass from the separating media into a collection zone; removing the contaminant from the collection zone; and withdrawing a purified gas or vapour stream from the bed of separating media.

While the method of the invention can, at least in principle, be used to removal contaminants from a wide range of contaminated gas or vapour streams, it is envisaged that it will have particular application in the food industry to remove contaminants such as fats and oils from contaminated air streams emanating from cooking installations.

The thickness of the separating media bed, ie its thickness in the direction in which the gas or vapour stream passes through it, may be between 3 cm and 15 cm, ie typically between 5 cm and 12 cm.

By curled separating media' is meant separating media comprising strips shaped to have the form of at least a partial ringlet or spiral.

In one embodiment of the invention, the curled separating media may each have a dimension or length of between 3 mm and 30 mm, eg from 15 mm to 20 mm. Typically, the curled separating media may then be in the form of metal shavings, eg aluminium or steel shavings. The thickness of the shavings may be less than 1 mm, and even less than 0.5 mm, eg about 0.1 mm, while the widths of the shavings may be between 1 mm and 1 Omm, eg about 5 mm. The radius of curvature of the shavings may be between 2 mm and 15 mm, eg about 8 mm. The length of the metal strips obtained by straightening the shavings may be between 30 mm and 100 mm, eg between 50 mm and 60 mm. The shavings may thus be of spiral or ringlet form. The separating media will then be arranged in irregular fashion in the bed.

However, in another embodiment of the invention, some or all of the curled separating media may be of elongate form, and may comprise a plurality of full spirals so that they are then each a spiral separating medium. Each spiral separating medium may then be of constant diameter along its length. The spiral separating media may be arranged in a regular fashion or pattern in the bed. Thus, the spiral separating media may extend parallel to each other in the bed, and the direction of movement or passage of the gas or vapour stream through the bed may be orthogonally to the longitudinal axes of all the spiral separating media. Thus, the bed may comprise a plurality of layers of the spiral separating media, with each layer comprising a plurality of the separating media located adjacent each other, eg in abutting relationship. Each layer of the separating media will thus rest on the separating media of the layer below it. Adjacent separating media in a layer may be of opposite hand, ie their spirals may rotate or extend in opposite directions. All the spiral separating media in a particular layer may be of the same diameter and length. In one embodiment, all the spiral separating media in all the layers may be of the same diameter and length. Smaller diameter media may then, if desired, be provided at the sides of some of the rows, to fill voids on the sides of the rows. However, in another embodiment, the separating media of alternate layers may be of the same diameter, D1, while the separating media of the intermediate layers may be of the same diameter, D2, where D1 is different to D2. Other combinations of differing diameter separating media can be used, if desired.

The gas or vapour stream may be at an elevated temperature, with the contaminant being in condensable vaporized form and/or in the form of fine droplets entrained or dispersed in the gas or vapour stream.

When the contaminated gas or vapour stream is a contaminated air stream emanating from a cooking installation, the air stream will thus be hot, and typically may be at about 170° C. The contaminants in the hot air stream will then be fat and/or oils which will be present in the hot contaminated air stream in the form of fine entrained droplets and/or in vaporized form. As the hot contaminated air stream passes through the bed of curled separating media, the droplets will impinge against the curved surfaces of the media, run down the media surfaces, and drip from the media into the collection zone. Any vaporized contaminants may condense on the separating media, run down the media surfaces and drip from the media into the collection zone.

The contaminated gas or vapour stream may thus be an off or waste gas stream emanating from a household, commercial or industrial cooker.

However, more specifically, the method may include, prior to passing hot contaminated air emanating from the cooker through the bed of curled separating media, admixing the hot contaminated air with cold air. The cold air will serve to condense any vaporized fats and oils in the contaminated air so that they will be converted into entrained liquid droplet form before encountering the bed of separating media.

The process may also include passing the purified gas or vapour stream through a scrubber for removing an undesired substance such as ammonia therefrom, and/or passing it through a biological filter for removal of a substance such as sulphur therefrom, before discharging the treated gas or vapour stream to atmosphere.

More specifically, the contaminated gas or vapour stream may pass linearly, in the upward direction, through the bed of separating media. The linear velocity of the gas or vapour stream through the bed may be up to 6 m/s, and is preferably about 3.2 m/s.

According to a second aspect of the invention there is provided apparatus for removing contaminants from a contaminated gas or vapour stream, which apparatus includes a gas/vapour chamber; a gas/vapour inlet leading into the chamber; a gas/vapour outlet leading from the chamber; separating means located in proximity to the gas/vapour inlet, the separating means comprising a bed of curled separating media, with the separating means adapted such that a contaminated gas or vapour stream that enters the chamber passes through the bed of curled separating media in an upward direction, with the curled separating media acting to separate contaminants from the gas or vapour as the gas or vapour stream passes through the bed; and collecting means for collecting contaminant that has collected on the separating media.

The chamber may be defined by a plurality of walls. Thus, for example, a front wall, a rear wall spaced from the front wall, top and bottom walls, and a pair of spaced side walls located between the front, bottom, rear and top walls, may be provided. The gas/vapour inlet may be provided in the front wall, while the gas/vapour outlet will then be provided in one of the other walls. The front wall may slope downwardly inwardly from the top wall to the bottom wall, so that it is thus inclined at an angle to the vertical. The front wall may be planar.

The separating means may comprise a holder which holds the separating media bed. The holder may comprise a base, a roof spaced from the base, and a pair of spaced sides between the roof and the base. The base, roof and sides may be in the form of plates. At the front of the holder, the base, roof and side plates may define a gas/vapour inlet opening, while a gas/vapour outlet opening may be defined by the base, roof and side plates at the rear of the holder. The inlet and outlet openings may be covered by apertured coverings, eg pieces of mesh or screens, holding the separating media bed in position.

The curled separating media and the bed of curled separating media may be as hereinbefore described.

The holder may be releasably mounted inside the chamber. More particularly, it may be releasably mounted in the gas/vapour inlet of the chamber, so that its plates extend transversely, preferably orthogonally, with respect to the chamber front wall. It will thus be located at an angle to the horizontal so that a contaminated gas/vapour stream that enters the gas/vapour inlet opening of the holder passes upwardly, and preferably linearly, through the separating means before exiting through the gas/vapour outlet opening of the holder.

The apparatus may thus include mounting means mounting the holder releasably to a wall of the chamber. The holder may be provided, in proximity to its gas/vapour inlet opening, with an outwardly protruding flange which engages the wall of the chamber around the gas/vapour inlet in the chamber wall. The mounting means may then include retaining means for retaining the holder flanges in position against the chamber wall. For example, the retaining means may comprise a channel member on the chamber wall for receiving a bottom flange of the holder, and a spring biased clip adapted to engage an upper flange of the holder releasably.

The collecting means may comprise a trough located below the gas/vapour inlet of holder of the separating means. The trough may comprise a base plate, a pair of spaced side plates and a front plate closing off the front edges of the base and side plates. The base plate of the trough may thus be fast with, eg formed integrally with, the base plate of the holder. Similarly, the side plates may each be fast with, eg formed integrally with, a side plate of the holder. Thus, the holder and trough may be in the form of a holder/trough combination.

The chamber may form part of an air collection hood located above cooking apparatus, such as a stove, griller, cooker, or the like.

According to a third aspect of the invention, there is provided a holder/trough combination for an apparatus for removing contaminants from a contaminated gas or vapour stream, the combination including a holder for holding a separating media bed, the holder comprising a base plate, a roof plate spaced from the base plate, and a pair of spaced side plates between the roof and base plates, with the base plate, the roof plate and the side plate defining, at the front of the holder, a gas/vapour inlet opening, while a gas/vapour outlet opening is defined by the base plate, the roof plate and the side plates at the rear of the holder; and a trough located below the gas/vapour inlet opening of the holder.

The trough may comprise a base plate, a pair of spaced side plates and a front plate closing off the front edges of the base and side plates, with the base plate of the trough being fast with the base plate of the holder, as hereinbefore described.

A bed of curled separating media, as hereinbefore described, may be provided inside the holder.

According to a fourth aspect of the invention, there is provided a cooking installation which includes cooking apparatus on which foodstuffs can be cooked; apparatus for removing contaminants from a contaminated air stream, according to the second aspect of the invention, above the cooking apparatus; an air extraction conduit leading from the air collection hood of the apparatus such that an inlet to the conduit is in communication with the gas/vapour outlet in one of the walls of the air collection hood; and air extraction means in or associated with the extraction conduit.

The cooking apparatus may, in particular, be adapted such that foodstuffs can be grilled thereon, eg by means of a gas flame. For example, it may be a gas cooker.

The conduit may be in the form of a duct. The extraction means may be an extraction fan mounted in the duct.

Apart from hot fat and oil laden air entering the separating apparatus, in use, cold air will also be drawn in from underneath the hood, with the cold air serving to condense the fats and oils from a gaseous form at a high temperature, typically about 170° C. immediately above the cooking apparatus, to a liquid form at a lower temperature, typically between ambient temperature and 100° C., eg 20° C. to 70° C., at which temperature all oils and fats are in liquid form and at which temperature efficient separation thereof in the bed of curled separating media can be effected.

BRIEF DESCRIPTION OF THE DRAWINGS

The invention will now be described in more detail, with reference to the accompanying diagrammatic drawings.

In the drawings.

DETAILED DESCRIPTION

Figure 1:
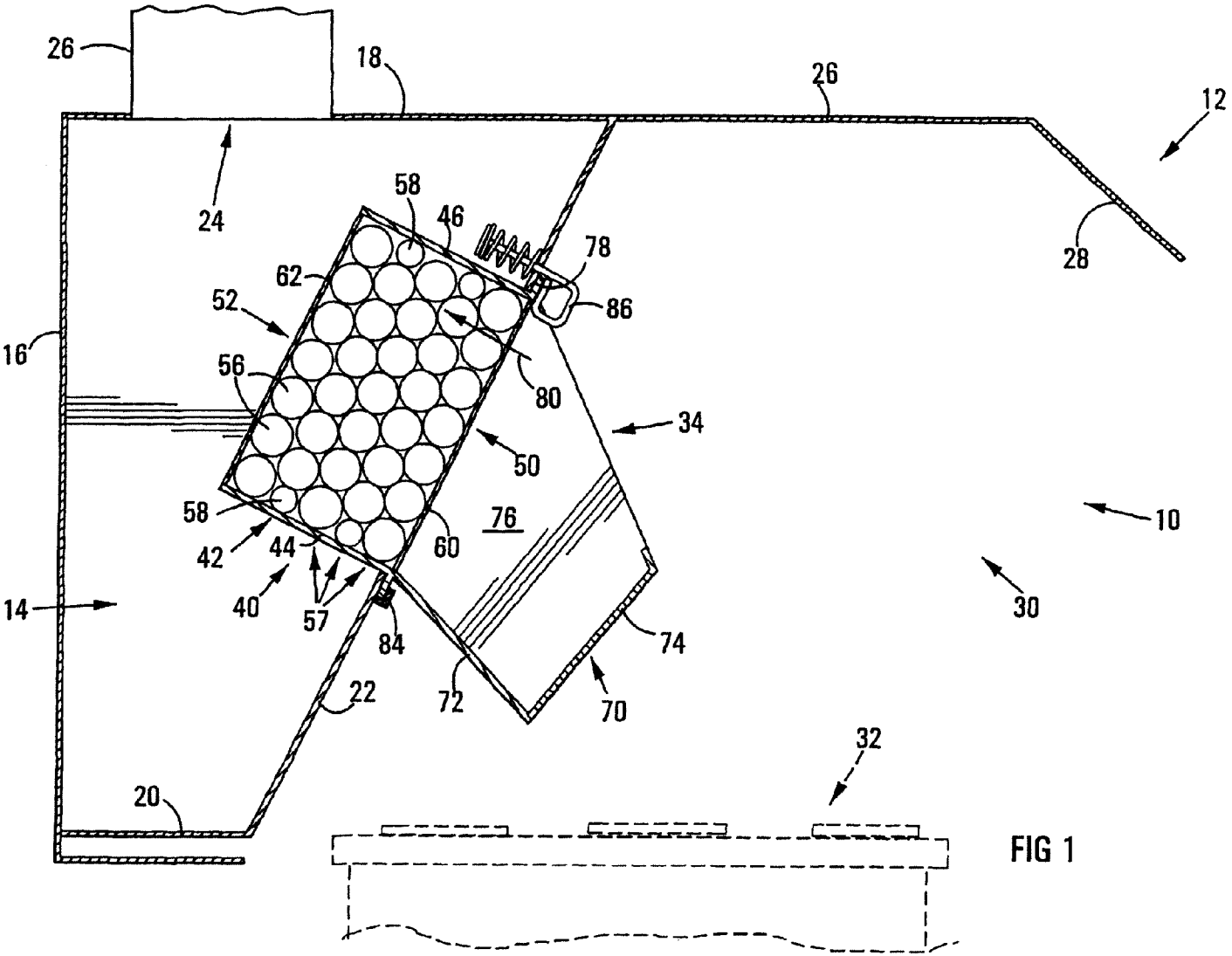
FIG. 1 shows a cross-sectional view of a cooking installation according to the invention.
Figure 2:
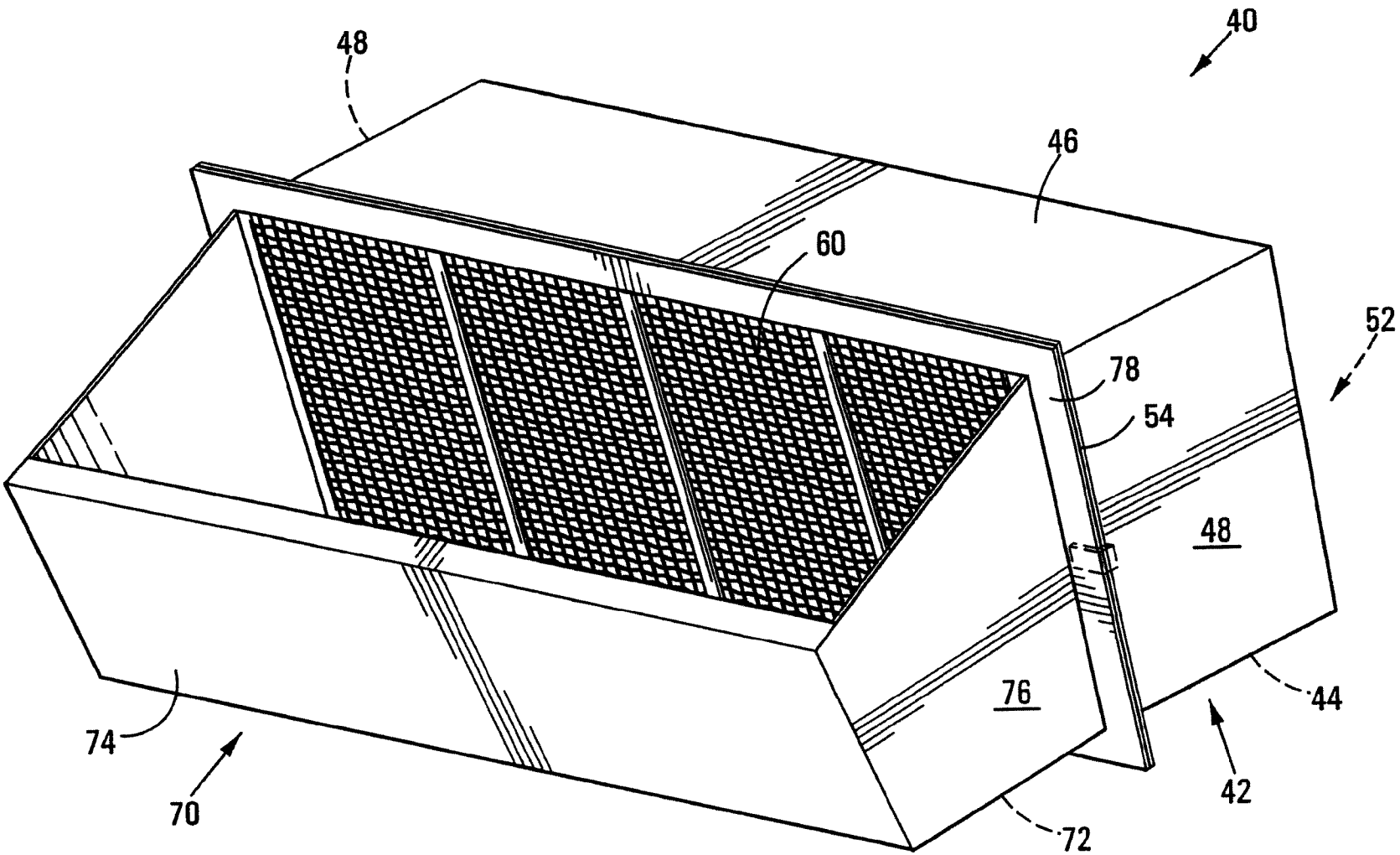
FIG. 2 shows an enlarged three-dimensional view of the separating means and trough of FIG. 1.

In the drawings, reference numeral 10 generally indicates a cooking installation according to the invention.

The cooking installation 10 includes an air collection hood, generally indicated by reference numeral 12. The hood 12 includes an air collection chamber generally indicated by reference numeral 14. The chamber 14 is defined by a rear planar wall 16 which is typically mounted against a vertical wall (not shown), a planar top wall 18 extending orthogonally to the rear wall 16, a bottom wall 20 extending parallel to the top wall 18, and a front planar wall 22 sloping downwardly inwardly from the top wall 18 to the bottom wall 20.

An air outlet opening 24 is provided in the top wall 18 with an air extraction duct 26 leading from the top wall 18 and being in communication with the air outlet opening 24.

A plate 26, which is integral with the top wall 18 of the air chamber 14, protrudes beyond the front wall 22, and is provided with a downwardly sloping end portion 28. An air collection zone, generally indicated by reference numeral 30, is thus defined between the front wall 22, the plate 26 and the end portion 28 of the plate 26, with the air collection zone 30 being located above a cooker 32.

A rectangular air inlet, generally indicated by reference numeral 34, is provided in the front wall 22.

The installation 10 includes separating means, generally indicated by reference numeral 40. The separating means 40 comprises a holder generally indicated by reference numeral 42. The holder 42 comprises a base plate 44, a roof plate 46 spaced from the base plate 44 and side plates 48 connecting the base and roof plates. At the front of the holder, the base, roof and side plates define a rectangular air inlet opening, generally indicated by reference numeral 50, while a rectangular air outlet opening, generally indicated by reference numeral 52, is defined by the base, roof and side plates at the rear of the holder 42.

Flanges 54 protrude peripheral and outwardly at the air inlet opening 50 of the holder 42. In other words, the flanges 54 protrude outwardly from the front edges of the plates 44,46 and 48.

The holder 42 is thus rectangular in cross-section, and is dimensioned such that it fits snugly in the air inlet 34 in the front wall 22 of the air chamber 14. Its flange 54 thus abuts against the front wall 22 around the air inlet 34 so that the plates 44,46 and 48 extends orthogonally to the front wall 22. Thus, air entering the air inlet 50 of the holder 42 passes through the holder 42 in an upward direction to exit through the air outlet 52.

The separating means 40 includes a bed of spiral separating media 56, which are all of the same diameter and typically have diameters of 20 mm. The media 56 are of metal, eg steel. The spiral separating media 56 are thus arranged in layers or rows 57 within the holder 42. The separating media 56 are arranged such that the spirals of adjacent media 56. rotate in opposite directions, ie are of opposite hand. At the ends of some of the rows 57, where there are gaps, smaller diameter spiral separating media 58 are located. Typically, the diameters of the spiral separating media 58 are about 6 mm. The separating media 58 serve to hold the separating media 56 in position, and also serve to ensure that air passing through the bed cannot bypass the bed by passing along the gaps at the end of the rows 57 and against the holder plates 44,46.

The bed of separating media 56,58 is retained in position by a screen 60 which spans the air inlet opening 50 of the holder 42 as well as a screen 62 which spans the air outlet opening 52 of the holder 42.

The installation 10 also includes a trough, generally indicated by reference numeral 70. The trough 70 includes a base plate 72, a front plate 74 and side plates 76. The base plate 72 is integral with the base plate 44 of the holder 42, ie it is an extension of the base plate 44. Similarly, the side plates 76 are integral with the side plates 48 of the holder 42 so that they are in effect extensions of the side plates 48.

A flange 78 protrudes peripheral around the holder 42, at its air inlet opening 50, ie along the lines where the base plates 42,72 and the side plates 48,76 meet. The flange 78 is typically welded in position.

The combination of the holder 42 and the trough 70 is held in position in and against the front plate 22 as follows: The bottom flange 78 is received tongue and groove fashion in a pair of spaced channel members 84 mounted to the front panel 22. The upper flange 78 is urged into contact with the front plate 22, and secured releasably in position, by a pair of spring loaded rotatable clips 86 which can be pivoted from operative positions in which they protrude from the front plate 22 and engage the upper flange 78, to inoperative positions (not shown) in which they are disengaged from the upper flange 78. The holder 42/trough 70 combination can then be removed, eg to empty the trough.

In use, foodstuffs are cooked on the stove 32. The foodstuffs release hot fats or oils, which can be in the form of liquid droplets or vaporized, into the air space 30 above the cooker. These fats and oils are entrained or drawn up with hot air which is sucked in, by means of a fan or blower, into the hood 12. The air is admixed with cold air which is also drawn into the space 30. The contaminated, ie the fat and oil laden, air passes through the inlet opening 50 of the separating means 40 and encounters the spiral separating media 56,58.

It will thus be appreciated that contaminated air entering the separating means 40, comprises a mixture of hot and cold air which is drawn in from underneath the hood 12, with the cold air serving to condense the fats and oils from a gaseous form at a high temperature, typically about 170° C. immediately above the cooker 32, to a liquid form at a lower temperature, typically between ambient temperature and 100° C., eg 20° C. to 70° C., at which temperature all such oils and fats will be in liquid form and at which temperature efficient separation thereof in the bed of spiral separating media can be effected.

As the contaminated air encounters the spiral separating media 56,58, the droplets of fats and oils entrained in the air impinge against the surfaces of the separating media, collect on the curved surfaces of the separating media, run down these surfaces of the separating media, and drip down to be collected in the trough 70. From time to time, eg once a day, the separating means/trough combination can be removed by undoing the clips attaching it to the front panel 22, in order to discharge fats and oils that have collected in the trough 70.

Purified air, ie air that is substantially free of entrained oils and fats, exits the separating means 40 through the outlet 52, is drawn through the opening 24 in the roof 18 of the hood 12 and is withdrawn along the ducts 26. It can then pass through a scrubber where it can be scrubbed with water to remove ammonia. It can also pass into a biological filter (not shown) where sulphurous compounds such as mercaptans can be removed. Thereafter it can be discharged into the air.

It will be appreciated that the air passes through the bed of separating media 56,58, in an upward direction and substantially linearly, as indicated by reference numeral 80.

It is believed that as the contaminated air enters the separating means 40 through the inlet 50, primary separation of liquefied fats and oils in droplet form will take place within the first few rows 57 of separating media 56,58, as indicated in FIG. 1. The rows 57 thus extend orthogonally to the direction of air travel 80 through the bed of separating media. Typically, it is believed that this primary separation can take place in the first 2 to 3 rows 57 of separating media 56,58. Thus, it is believed that the screen 60 covering the opening 50 and the separating media in these first few rows 57 will remain wet due to condensation taking place in these separating media as well as the drops that collect on the media and pass downwardly from one separating medium 56, 58 to the separating medium below it. This ensures that the condensed liquids, ie the liquefied fats and oils that collect on the separating media are retained on the surfaces and slowly work their way down the rows 57 of separating media. At the bottommost separating medium 56 at the front of the holder 42, it is believed that a vortex will be created which will enhance passage of the fats and oils into the trough 74. Advantages arising from this are that the separating media 56,58 towards the rear of the holder 42 remain more-or-less dry, thus ensuring effective secondary separation of residual fats and oils still present in the air after it has passed through the initial layers 82 of separating media. Additionally, the wet 'filter face' provided by the first few wet rows 57 of separating media 56,58 will assist in capturing carbon and other solid particles present in the air, causing them to adhere to the front screen 60 and to the separating media 56,58 in the rows 57, and washed down with the condensed liquids (fats and oils) thus ensuring that the separating means 40 as a whole remains cleaner.

Typically, the linear velocity of the air through the separating means 40 is in the order of 3.2 m/s. However, on the air exiting the outlet opening 52 in the holder 42, a drastic reduction in velocity is experienced due to the size of the air chamber 14.

This, it is believed, will contribute to preventing fat and oil droplet carry over from the separating means 40 into the chamber 14. it is also believed that the combination of the separating means 40/trough 74 combination will facilitate maintenance. For example, the combination cannot be fitted incorrectly due to the clips that retain it in position. Secondly it is easy to remove, clean and re-install. Additionally, a tight seal is provided by the flanges 54,78 against the front panel 22.

It is also believed that the pressure drop through the bed of spiral separating media 56,58 will be very small, due to the straight upward direction of flow of the air through the bed. This, it is believed, will enhance separation. Additionally, due to this relatively low pressure drop, a relatively inexpensive fan or blower can be used. The air speed through the separating means 40 can be relatively low.

It is further believed that the low air speed used as well as the fact that the separating media in the rows 82 are continuously coated with liquid, will result in low noise levels so that the installation 10 will be relatively quiet during operation. Thus, the air flow rate through the bed is typically about 3.2 m/s with the upper limit being 6 m/s to prevent excessive noise and pressure drop.

The bed of separating media 56,58 also constitutes a flame barrier, in the event that foodstuffs being cooked on the cooker 32 ignite. The trough 70, which may contain combustible fats and oils is thus located upstream of the separating media bed so that substantially no combustible fats and oils are found downstream of the separating media bed, which is an added safety factor.

The invention claimed is:

1. A method of removing contaminants from a contaminated gas or vapour stream, which method includes passing a contaminated gas or vapour stream, which is at an elevated temperature and which contains a contaminant in condensable vaporized form and/or in the form of fine droplets entrained in the gas or vapour stream, through a bed of elongate spiral separating media linearly in an upward direction at a linear velocity of up to 6 m/s, the bed comprising a plurality of layers of the spiral separating media, with each layer comprising a plurality of the separating media located adjacent each other and with the separating media of one layer thus resting on the separating media of the layer below it;

as the gas or vapour stream passes through the bed of separating media, allowing the contaminant in the contaminated gas or vapour stream to collect on the separating media of the first few rows of separating media by primary separation wherein the separating media remain wet due to condensation taking place in the separating media as well as drops that collect on the media and pass down from one separating medium to the separating medium below it, with the wet separating media assisting in capturing carbon and other solid particles present in the gas or vapour stream by causing them to adhere to the wet separating media in the first few rows and being washed down with the condensed liquid, and with the separating media towards the rear of the separating media bed remaining more-or-less dry thus ensuring effective secondary separation of residual contaminants still present in the gas or vapour stream after it has passed through the wet first few layers of separating media, thereby removing the contaminant from the gas or vapour stream and thus purifying the gas or vapour stream;

allowing the contaminant that has collected on the separating media to pass from the separating media into a collection zone;

removing the contaminant from the collection zone; and withdrawing a purified gas or vapour stream from the bed of separating media.

2. A method according to claim 1, wherein the thickness of the separating media bed is between 3 cm and 15 cm.

3. A method according to claim 1, wherein the curled separating media each have a dimension or length of between 3 mm and 30 mm; wherein the curled separating media are in the form of metal shavings; and wherein the shavings are less than 1 mm thick, and between 1 mm and 10 mm wide.

4. A method according to claim 1, wherein each spiral separating medium is of constant diameter along its length, with the spiral separating media being arranged in a regular fashion or pattern in the bed; wherein the spiral separating media extend parallel to one another in the bed, and the direction of movement or passage of the gas or vapour stream through the bed is orthogonally to the longitudinal axes of all the spiral separating media; wherein the bed comprises a plurality of layers of the spiral separating media, with each layer comprising a plurality of the separating media located adjacent each other, and with each layer of the separating media thus resting on the separating media of the layer below it; and wherein adjacent separating media in each layer are of opposite hand so that their spirals rotate or extend in opposite direction.

5. A method according to claim 1, wherein the gas or vapour stream is at an elevated temperature, with the contaminant being in condensable vaporized form and/or in the form of fine droplets entrained or dispersed in the gas or vapour stream.

6. A method according to claim 1, which includes passing the purified gas or vapor stream through a scrubber and/or biological filter to remove an undesired substance therefrom, before discharging the treated gas or vapour stream to atmosphere.

* * * * *

UNITED STATES PATENT AND TRADEMARK OFFICE

CERTIFICATE OF CORRECTION

PATENT NO. : 7,767,003 B2
APPLICATION NO. : 12/039802
DATED : August 3, 2010
INVENTOR(S) : Erasmus Van Niekerk It is certified that error appears in the above-identified patent and that said Letters Patent is hereby corrected as shown below:

On the Cover Page:

At field (73), "Veritruff (Proprietary) Limited" should be -- Verituff (Proprietary) Limited --.

Signed and Sealed this
Seventh Day of June, 2011

David J. Kappos

David J. Kappos
*Director of the United States Patent and Trademark Office*